US007364650B2

(12) United States Patent
Font Freide

(10) Patent No.: US 7,364,650 B2
(45) Date of Patent: Apr. 29, 2008

(54) FISCHER TROPSCH COMPOSITION AND PROCESS

(75) Inventor: Josephus Johannes Helena Maria Font Freide, Guilford (GB)

(73) Assignee: BP Exploration Operating Company Limited, Middlesex (GB)

( * ) Notice: Subject to any disclaimer, the term of this patent is extended or adjusted under 35 U.S.C. 154(b) by 309 days.

(21) Appl. No.: 10/494,612

(22) PCT Filed: Nov. 5, 2002

(86) PCT No.: PCT/GB02/04999

§ 371 (c)(1),
(2), (4) Date: May 4, 2004

(87) PCT Pub. No.: WO03/040261

PCT Pub. Date: May 15, 2003

(65) Prior Publication Data

US 2004/0256288 A1 Dec. 23, 2004

(30) Foreign Application Priority Data

Nov. 6, 2001 (GB) ..... 0126648.5

(51) Int. Cl.
*C10G 57/00* (2006.01)
*C10G 63/04* (2006.01)

(52) U.S. Cl. ..... 208/67; 208/69; 208/950; 585/417; 585/644; 423/210

(58) Field of Classification Search ..... 208/67, 208/69, 950; 423/210; 585/417, 644
See application file for complete search history.

(56) References Cited

U.S. PATENT DOCUMENTS

| | | | | |
|---|---|---|---|---|
| 3,296,324 | A * | 1/1967 | Csicsery | 585/417 |
| 4,126,644 | A | 11/1978 | Caesar et al. | |
| 6,103,206 | A | 8/2000 | Taylor, Jr. et al. | |
| 6,168,768 | B1 * | 1/2001 | Alexion et al. | 423/210 |
| 6,369,286 | B1 * | 4/2002 | O'Rear | 585/644 |

FOREIGN PATENT DOCUMENTS

GB 2 255 090 A 10/1992

* cited by examiner

*Primary Examiner*—Glenn Caldarola
*Assistant Examiner*—Prem C. Singh
(74) *Attorney, Agent, or Firm*—Nixon & Vanderhye

(57) ABSTRACT

The present invention provides an upgraded synthetic gasoline having a true boiling point (TBP) range of between 50° C.-300° C., a sulphur content of less than 1 ppm, a nitrogen content of less than 1 ppm, an aromatics content of between 0.01%-35% by weight, an olefins content of between 0.01%-45%, a benzene content of less than 1.00% by weight, an oxygen content of between 0.5-3.0% by weight, a RON of greater than 80, and a MON of greater than 80. The invention also provides processes for the production of the upgraded synthetic gasoline wherein the synthetic products derived from a Fischer-Tropsch reaction are passed to a cracking reactor to produce a synthetic gasoline stream which is subsequently fractionated and upgraded using an oxygenating reactor, and optionally a combination of an MTBE reactor, a dehydrocyclodimerisation reactor and C5 isomerisation reactor. The upgraded synthetic gasoline is useful as a fuel.

25 Claims, 2 Drawing Sheets

FISCHER TROPSCH COMPOSITION AND PROCESS

Figure 1:
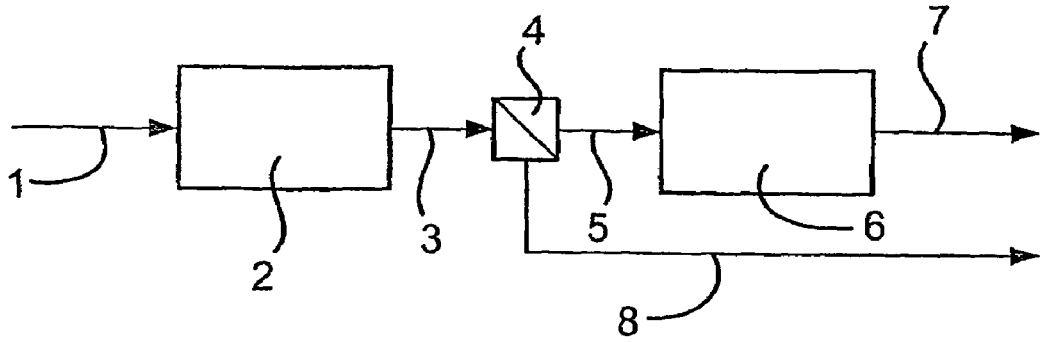

This application is the U.S. National Phase of International Application PCT/GB02/04999, filed 5 Nov. 2002, which designated the U.S.

The present invention provides upgraded synthetic gasolines, processes for the preparation of said gasolines and the use of said synthetic gasolines as a fuel.

Conventionally gasoline is prepared by fractional distillation of crude oil. However gasoline produced from crude oil often contains high percentages of sulphur and nitrogen and produces harmful emissions when it is used as a fuel in combustion engines. Such emissions include sulphur oxides, carbon monoxide, oxides of nitrogen and volatile hydrocarbons.

It has now been found that upgraded synthetic gasoline derived from the products of the Fischer-Tropsch reaction produces less harmful emissions when used as a fuel and usually contains lower levels of sulphur and nitrogen compared with conventional fuels and can exhibit a high research octane number (RON) and a high motor octane number (MON).

Accordingly the present invention provides a process for the production of an upgraded synthetic gasoline comprising a) contacting a synthesis gas stream at an elevated temperature and pressure with a Fischer-Tropsch catalyst in a Fischer-Tropsch reactor to generate a hydrocarbon product stream comprising hydrocarbons having a chain length of between 1 to 30 carbon atoms
b) passing at least a portion of the hydrocarbon product stream to a cracking reactor wherein the hydrocarbon product stream is contacted with a cracking catalyst under conditions which provide a synthetic gasoline stream consisting essentially of hydrocarbons having a chain length of between 1 to 12 carbon atoms
c) separating the synthetic gasoline stream produced in step (b) to provide at least one stream comprising hydrocarbons containing less than 6 carbon atoms and at least one stream comprising hydrocarbons containing at least 6 carbon atoms
d) passing the stream comprising hydrocarbons containing less than 6 carbon atoms to an oxygenating reactor wherein it is reacted with oxygenates to produce a stream comprising ethers and
e) blending at least a portion of the stream comprising ethers with the stream comprising hydrocarbons containing at least 6 carbon atoms to produce an upgraded synthetic gasoline.

In another embodiment of the invention the synthetic gasoline stream produced in step (b) is separated to provide at least one stream comprising hydrocarbons containing less than 7 carbon atoms and at least one stream comprising hydrocarbons containing at least 7 carbon atoms wherein the stream comprising hydrocarbons containing less than 7 carbon atoms is passed to the oxygenating reactor wherein it is reacted with oxygenates to produce a stream comprising ethers. This stream may then be subsequently blended with the stream comprising hydrocarbons containing at least 7 carbon atoms to produce an upgraded synthetic gasoline.

Alternatively the synthetic gasoline stream produced in step (b) may also be separated to provide at least one stream comprising hydrocarbons containing 4 carbon atoms, at least one stream comprising hydrocarbons containing 5-6 carbon atoms and at least one stream comprising hydrocarbons containing at least 7 carbon atoms.

At least a portion of the stream comprising hydrocarbons containing 4 carbon atoms may be passed to a methyl tertiary-butyl ether (MTBE) reactor wherein it is contacted in the presence of an oxygenate with a MTBE catalyst to produce a stream comprising a MTBE. Optionally the stream comprising hydrocarbons containing 4 carbon atoms may also comprise hydrocarbons containing 3 carbon atoms.

The stream comprising hydrocarbons containing 5-6 carbon atoms may be passed to an oxygenating reactor wherein it is reacted with oxygenates to produce a stream comprising ethers. A stream of unreacted hydrocarbons containing 5 carbon atoms may be passed from the oxygenating reactor to a C5 isomerisation reactor wherein it is contacted with a C5 isomerising catalyst to produce a stream comprising C5 isoparaparaffins.

In a preferred embodiment of the invention the stream comprising MTBE, the stream comprising ethers, optionally the stream comprising C5 isoparaparaffins and the stream comprising hydrocarbons containing at least 7 carbon atoms may be blended to produce an upgraded synthetic gasoline.

In another alternative embodiment the synthetic gasoline stream produced in step (b) may also be separated to provide at least one stream comprising hydrocarbons containing 3-4 carbon atoms, at least one stream comprising hydrocarbons containing 5-6 carbon atoms and at least one stream comprising hydrocarbons containing at least 7 carbon atoms wherein at least a portion of the stream comprising hydrocarbons containing 3-4 carbon atoms may be passed to a dehydrocyclodimerisation reactor wherein it is contacted with a dehydrocyclodimerisation catalyst to produce a stream comprising aromatics. The stream comprising hydrocarbons containing 5-6 carbon atoms may be passed to an oxygenating reactor wherein it is reacted with oxygenates to produce a stream comprising ethers. A stream of unreacted hydrocarbons containing 5 carbon atoms may be passed to a C5 isomerisation reactor from the oxygenating reactor wherein it is contacted with a C5 isomerising catalyst to produce a stream comprising C5 isoparaparaffins.

In a preferred embodiment the stream comprising aromatics, the stream comprising ethers, optionally the stream comprising C5 isoparaparaffins and the stream comprising hydrocarbons containing at least 7 carbon atoms may be blended to produce an upgraded synthetic gasoline.

The synthesis gas stream may be produced by passing steam over red-hot coke. Alternatively the synthesis gas stream may be produced from crude oil or from biomass via a gasification process.

In a preferred embodiment the synthesis gas stream is produced by passing a natural gas stream to a reforming zone to produce the synthesis gas stream.

Usually natural gas streams contain sulphur and the sulphur is preferably removed by contacting the natural gas stream comprising sulphur with an adsorbent in an adsorption zone to produce a natural gas stream with reduced sulphur content and an adsorbent with an increased sulphur content.

Sulphur may be present in the natural gas feed as organic sulphur containing compounds e.g. mercaptans or carbonyl sulphide but is usually present in the natural gas stream as hydrogen sulphide. The natural gas stream may also comprise olefins and carbon monoxide. The sulphur is preferably removed by passing the natural gas stream comprising sulphur over an adsorbent at a temperature of between 250-500° C., more preferably between 350-400° C. and at a pressure of 10-100 bar, more preferably between 30-70 bar e.g. 50 bar. The adsorbent may be a copper on graphite adsorbent (e.g. copper on activated carbon) but is preferably a zinc oxide adsorbent wherein the zinc oxide is contacted with hydrogen sulphide and converted to zinc sulphide.

If the sulphur content of the natural gas stream is above 30 ppm, preferably above 50 ppm the gas stream may be contacted with an amine prior to being passed to the adsorption zone.

Advantageously if the natural gas stream comprising sulphur also comprises organic sulphur containing compounds the gas stream may be contacted with a mercaptan conversion catalyst prior to contacting the adsorbent. The mercaptan conversion catalyst converts the organic sulphur containing compounds e.g. mercaptans to hydrogen sulphide. The gas stream is usually contacted with the mercaptan conversion catalyst at a temperature of between 250-500° C., more preferably between 350-400° C. and at a pressure of 10-100 bar, more preferably between 30-70 bar e.g. 50 bar.

The mercaptan conversion catalyst is usually a supported metal catalyst and comprises at least one metal selected from the group consisting of platinum, palladium, iron, cobalt, nickel, molybdenum, and tungsten on a support material. Preferably the mercaptan conversion catalyst comprises at least two metals selected from the above group and most preferably the mercaptan conversion catalyst comprises molybdenum and cobalt.

The support may be a solid oxide having surface OH groups. The support may be a solid metal oxide especially an oxide of a di, tri or tetravalent metal. The metal of the oxide may be a transition metal, a non transition metal or a rare earth metal. Examples of solid metal oxides include alumina, titania, cobaltic oxide, zirconia, ceria, molybdenum oxide, magnesia and tungsten oxide. The support may also be a solid non metal oxide such as silica. The support may also be a mixed oxide such as silica-alumina, magnesia-alumina, alumina-titania or a crystalline aluminosilicate. Preferably the support is alumina.

The total weight of metal in the mercaptan conversion catalyst may be 0.2-20% by weight (as metal) based on the weight of support. The mercaptan conversion catalyst preferably comprises at least 1% e.g. 1-30% such as 10-20% e.g. 12% of molybdenum (based on the weight of support) and at least 0.1% of cobalt e.g. 0.1-20% such as 3-10% e.g. 4% of cobalt (based on the weight of support) is usually present.

Alternatively if the natural gas stream comprising sulphur and organic sulphur containing compounds also contains olefins and/or carbon monoxide the gas stream may be contacted with an olefin conversion catalyst prior to contacting the adsorbent.

The olefin conversion catalyst is used to remove olefins and/or carbon monoxide from the natural gas stream wherein the olefins are converted to methane and the carbon monoxide is converted to carbon dioxide. The gas stream may be contacted with the olefin conversion catalyst at a temperature of between 400-1100° C., more preferably between 500-700° C. and at a pressure of 10-100 bar, more preferably between 30-70 bar e.g. 50 bar.

The olefin conversion catalyst is also a supported metal catalyst as described above but preferably comprises at least 1% e.g. 1-50% such as 10-30% e.g. 25% of nickel (based on the weight of support) and the support is preferably alumina.

The synthesis gas may be prepared in the reforming zone using any of the processes known in the art. The reforming zone may be substantially free of reforming catalyst as in a partial oxidation reaction where an oxygen containing gas is used to partially combust the natural gas to provide a synthesis gas stream comprising natural gas.

Alternatively the reforming zone comprises a reforming catalyst as in steam reforming or autothermal reforming. The reaction of natural gas with steam is known as steam reforming, while the reaction of natural gas with steam in the additional presence of oxygen or air or any combination thereof is known as autothermal reforming. Either steam reforming or autothermal reforming, or a combination of both, may be used.

Specific combinations of steam reforming and autothermal reforming are known. In series reforming, the product from a steam reformer is passed to an autothermal reformer along with fresh natural gas and oxygen containing feed. In convective reforming, steam and natural gas are partially reacted in a steam reformer, and the product is passed to an autothermal reformer along with fresh natural gas, steam and oxygen containing feed. The product stream from the autothermal reformer, which is at a very high temperature, is circulated back to the steam reformer. Suitably, the product stream from the autothermal reformer is passed through a heat exchanger prior to being recycled to the reaction zone of the steam reformer so as to provide a source of heat for the steam reforming reaction. The heat exchanger is preferably a 'shell and tube heat exchanger'. Any of these arrangements may be used in the process of the present invention.

The reforming reaction is preferably carried out at a temperature in the range of from 700 to 1100° C., especially 780 to 1050° C. The pressure of the reforming zone is preferably in the range of from 10 to 80 bar, especially 20 to 40 bar. Any suitable reforming catalyst, for example a nickel catalyst, may be used.

Preferably, the reforming zone is a "Compact Reformer" as described in "Hydrocarbon Engineering", 2000, 5, (5), 67-69; "Hydrocarbon Processing", 79/9, 34 (September 2000); "Today's Refinery", 15/8, 9 (August 2000); WO 99/02254; and WO 200023689.

Usually the ratio of hydrogen to carbon monoxide in the synthesis gas produced in the reforming zone and used in the Fischer-Tropsch synthesis step of the process of the present invention is in the range of from 20:1 to 0.1:1, especially 5:1 to 1:1 by volume, typically 2:1 by volume. The synthesis gas may contain additional components such as nitrogen, water, carbon dioxide and lower hydrocarbons such as unconverted methane.

The Fischer-Tropsch catalyst which may be employed in the process of the present invention is any catalyst known to be active in Fischer-Tropsch synthesis. For example, Group VIII metals whether supported or unsupported are known Fischer-Tropsch catalysts. Of these iron, cobalt and ruthenium are preferred, particularly iron and cobalt, most particularly cobalt.

A preferred catalyst is supported on an inorganic oxide, preferably a refractory inorganic oxide. Preferred supports include silica, alumina, silica-alumina, the Group IVB oxides, titania (primarily in the rutile form) and most preferably zinc oxide. The support generally has a surface area of less than about 100 $m^2/g$ but may have a surface area of less than 50 $m^2/g$ or less than 25 $m^2/g$, for example, about 5$m^2/g$.

Alternatively the support may comprise carbon.

The catalytic metal is present in catalytically active amounts usually about 1-100 wt %, the upper limit being attained in the case of unsupported metal catalysts, preferably 2A40 wt %. Promoters may be added to the catalyst and are well known in the Fischer-Tropsch catalyst art. Promoters can include ruthenium, platinum or palladium (when not the primary catalyst metal), aluminium, rhenium, hafnium, cerium, lanthanum and zirconium, and are usually present in amounts less than the primary catalytic metal (except for ruthenium which may be present in coequal amounts), but the promoter:metal ratio should be at least 1:10. Preferred promoters are rhenium and hafnium.

The catalyst may have a particle size in the range 5 to 3000 microns, preferably 5 to 1700 microns, most preferably 5 to 500 microns, and advantageously 5 to 100 microns, for example, in the range 5 to 30 microns.

The Fischer-Tropsch reaction is preferably carried out at a temperature of 180-360° C., more preferably 190-240° C. and at a pressure of 5-50 bar, more preferably 15-35 bar, generally 20-30 bar.

The synthesis gas may be contacted with the Fischer-Tropsch catalyst in any type of reactor for example in a fixed or fluidized bed reactor but, preferably, is contacted with the Fischer-Tropsch catalyst in a slurry reactor e.g. a slurry bubble column in which a Fischer-Tropsch catalyst is primarily distributed and suspended in the slurry by the energy imparted from the synthesis gas rising from the gas distribution means at the bottom of the slurry bubble column as described in, for example, U.S. Pat. No. 5,252,613.

The synthesis gas may also be contacted with a suspension of a particulate Fischer-Tropsch catalyst in a liquid medium in a system comprising at least one high shear mixing zone and a reactor vessel. This Fischer-Tropsch process is described in PCT patent application number WO0138269 which is herein incorporated by reference.

The hydrocarbon product stream generated in step (a) has a broad molecular weight distribution comprising predominantly straight chain, saturated hydrocarbons which typically have a chain length of between 1 to 30 carbon atoms.

Preferably hydrocarbons with between 1 to 3 carbon atoms are recycled back to the reforming zone and/or to the Fischer-Tropsch reactor. The remainder of the resultant hydrocarbon product stream may be passed directly to the cracking reactor.

Alternatively the remainder of the hydrocarbon product stream may be separated into at least one lighter fraction usually comprising hydrocarbons with between 5 to 14 carbon atoms and at least one heavier fraction usually comprising hydrocarbons with between 15 to 30 carbon atoms. Suitably this separation is achieved by flash distillation wherein the hydrocarbon product stream is passed to a vessel and the temperature of the stream is raised and/or the pressure of the stream is lowered such that a gaseous lighter fraction may be separated from a non-gaseous heavier fraction.

The heavier fraction may then passed to the cracking reactor.

The cracking reactor contains a cracking catalyst which is preferably a zeolite or zeotype material having a structure made up of tetrahedra joined together through oxygen atoms to produce an extended network with channels of molecular dimensions. The zeolite/zeotypes have SiOH and/or Al—OH groups on the external or internal surfaces. The zeolite may be natural e.g. analcime, chabazite, clinoptilite, erionite, mordenite, laumontite, phillipsite, gmelinite, brewsterite and faujasite or may be a synthetic zeolite. Examples of zeolite or zeotype catalysts are of MEL, MFI or TON types such as ZSM5, 12, 23, 35 A, B, X, Y, ZSM8, ZSM11, ZSM 12, ZSM35, MCM-22, MCM-36 and MCM-41. Preferably the cracking catalyst is a ZSM5 zeolite e.g. silica bound H-ZSM5.

The cracking reaction is preferably carried out at a temperature of between 250-450° C., more preferably between 330-430° C. and at a pressure of between 10-50 bar, more preferably between 20-40 bar. The cracking reaction may be carried out in the presence of hydrogen but is usually carried out in the absence of hydrogen. The synthetic gasoline stream produced comprises essentially of hydrocarbons having a chain length of between 1 to 12 carbon atoms. Hydrocarbons with between 1 to 3 carbon atoms may be separated from the synthetic gasoline stream and recycled back to the reforming zone and/or to the Fischer-Tropsch reactor.

The synthetic gasoline stream produced in step (b) may be separated to provide at least one stream comprising hydrocarbons containing less than 6 or less than 7 carbon atoms and at least one stream comprising hydrocarbons containing at least 6 or at least 7 carbon atoms. Suitably this separation is achieved by flash distillation. The stream comprising hydrocarbons containing less than 6 or less than 7 carbon atoms may then be passed to an oxygenating reactor.

The oxygenating reactor may contain an oxygenating catalyst. The oxygenating catalyst may be an ion exchange resin and is preferably a sulphonated macroporous ion exchange resin. Advantageously the exchange resin is based upon polystyrene chains cross linked with divinylbenzene. In a preferred embodiment of the invention an additional palladium loaded resin is used and usually the resins are located in two fixed bed reactors. Preferably the palladium loaded resin is located upstream of the sulphonated macroporus ion exchange resin. The oxygenating reaction is usually carried out in the presence of an oxygenate e.g. methanol.

The oxygenating reaction is preferably carried out at a temperature of 20° C.-200° C., more preferably 50° C.-150° C. and at a pressure of 10-50 bar, more preferably 15-30 bar.

A stream of unreacted hydrocarbons containing 5 carbon atoms may be passed from the oxygenating reactor to a C5 isomerisation reactor wherein it is contacted with a C5 isomerising catalyst to produce a stream comprising C5 isoparaparaffins.

The synthetic gasoline stream produced in step (b) may also be separated to provide at least one stream comprising hydrocarbons containing 4 or 3-4 carbon atoms, at least one stream comprising hydrocarbons containing 5-6 carbon atoms and at least one stream comprising hydrocarbons containing at least 7 carbon atoms. Suitably this separation is achieved by fractionation.

The stream comprising hydrocarbons containing 4 carbon atoms or 3-4 carbon atoms may be passed to a MTBE reactor. The MTBE reactor may contain an MTBE catalyst.

The MTBE reaction is preferably carried out at a temperature of 30-100° C., more preferably 40-80° C. and at a pressure of 10-50 bar, more preferably 20-30 bar.

The MTBE reaction is usually carried out in the presence of an oxygenate e.g. methanol.

The stream comprising hydrocarbons containing 3-4 carbon atoms may be passed to a dehydrocyclodimerisation reactor.

The dehydrocyclodimerisation reactor contains a dehydrocyclodimerisation catalyst. The catalyst may be a zinc loaded alumina wherein the zinc may be present as such or as zinc oxide or zinc sulphate but is preferably a gallium loaded ZSM-5 type aluminosilicate zeolite.

The dehydrocyclodimerisation reaction is usually carried out at a temperature of 350-750° C., more preferably 400-600° C. and at a pressure of 10-40 bar, more preferably 15-25 bar. The resultant stream comprises aromatics and usually comprises benzene, toluene and/or xylenes. Aromatic compounds with greater than 9 carbon atoms may also be present.

The synthetic gasoline stream produced by step (b) usually has a true boiling point (TBP) range of between 50° C.-300° C. and preferably between 100° C.-200° C. and a sulphur content of less than 1 ppm, preferably less than 0.5 ppm e.g. less than 0.1 ppm. Usually the synthetic gasoline stream also has a nitrogen content of less than 1 ppm, preferably less than 0.5 ppm e.g. less than 0.1 ppm. Advantageously the synthetic gasoline stream has an aromatics content of between 0.01%-25% by weight. Preferably the synthetic gasoline stream has an olefins content of between 0.01%-50% by weight, preferably between 10-45% by weight. Typically the synthetic gasoline has a benzene content of less than 1.00% by weight, preferably less than 0.75% by weight most preferably less than 0.50% by weight.

The synthetic gasoline stream has research octane number (RON) of greater than 30, preferably greater than 50, and most preferably greater than 90. Preferably the synthetic gasoline stream has a motor octane number (MON) of greater than 30, preferably greater than 50, and most preferably greater than 80.

The upgraded synthetic gasoline stream usually has a true boiling point (TBP) range of between 50° C.-300° C. and preferably between 100° C.-200° C. and a sulphur content of less than 1 ppm, preferably less than 0.5 ppm e.g. less than 0.1 ppm. Usually the upgraded synthetic gasoline stream also has a nitrogen content of less than 1 ppm, preferably less than 0.5 ppm e.g. less than 0.1 ppm. Advantageously the upgraded synthetic gasoline stream has an aromatics content between 0.01%-35% by weight e.g. between 10-30% by weight. Preferably the upgraded synthetic gasoline stream has an olefins content of between 0.01%-45%, preferably between 10-25% by weight.

Typically the upgraded synthetic gasoline has a benzene content of less than 1.00% by weight, preferably less than 0.75% by weight most preferably less than 0.50% by weight. Usually the upgraded synthetic gasoline has an oxygen content of between 0.5-3.0% by weight, preferably between 0.8-2.2% by weight.

The upgraded synthetic gasoline stream has RON of greater than 80, preferably greater than 90, and most preferably greater than 95. Preferably the upgraded synthetic gasoline stream has a MON of greater than 80, preferably greater than 85, and most preferably greater than 90.

The upgraded synthetic gasoline can be used as fuel or alternatively can be used as a blending component for conventional fuels to improve their performance.

The invention will now be described in the following examples.

EXAMPLE 1

A hydrocarbon product stream produced by a Fischer-Tropsch reactor was passed to a cracking reactor wherein the hydrocarbon product stream was contacted with a silica bound H-ZSM-5 catalyst. The hydrocarbon product stream was passed to the cracking reactor at a gas hourly space velocity (GHSV) of $0.96h^{-1}$. Nitrogen was also passed to the cracking reactor at a GHSV of $1400h^{-1}$. The temperature of the cracking reactor was maintained in the temperature range of 338-400° C. The performance of the cracking reactor was selected so that the concentration of aromatics in the synthetic gasoline stream produced was maximised but did not exceed 25 wt % by weight. The product analysis of the synthetic gasoline stream is shown in Table 1.

TABLE 1

| Yield/wt % | |
|---|---|
| Methane | 0.03 |
| Ethane | 0.12 |
| Ethane | 0.40 |
| Propane | 8.00 |
| Propene | 1.66 |

TABLE 1-continued

| | |
|---|---|
| i-Butane | 8.91 |
| n-Butane | 8.02 |
| i-Butene | 1.61 |
| n-Butene | 1.97 |
| t-Pentenes | 2.55 |
| o-Pentenes | 0.97 |
| t-Hexenes | 1.16 |
| o-Hexenes | 0.65 |
| Heptenes | 1.61 |
| $C_8$-$C_{11}$ olefins | 3.48 |
| i-Pentane | 7.05 |
| n-Pentane | 6.26 |
| i-Hexane | 5.28 |
| n-Hexane | 3.47 |
| Heptanes | 5.68 |
| $C_8$-$C_{11}$ paraffins | 13.02 |
| Naphthenes | 0.85 |
| Benzene | 0.53 |
| Toluene | 2.46 |
| $C_8$ aromatics | 6.07 |
| $C_9$ aromatics | 5.70 |
| $C_{10}$ aromatics | 2.44 |
| $C_{11}$ aromatics | 0.01 |
| Conversion/wt % | 89.44 |
| Dry Gas | 0.56 |
| LPG | 30.17 |
| Gasoline | 69.26 |
| Cracked Gasoline Composition/wt % | |
| Aromatics | 24.86 |
| Olefins | 15.05 |
| Benzene | 0.77 |
| RON | 90.1 |
| MON | 81.5 |

The C4 and C5 components were distilled from the synthetic gasoline stream and passed to an oxygenating reactor wherein the iso and tertiary olefins were etherified with methanol. An upgraded synthetic gasoline product was made by blending the etherified spirit with the C6+ product from the synthetic gasoline stream. The C3 material produced in the cracking reactor together with any unconverted C4's from the oxygenating reactor was recycled to a reforming zone.

The product analysis of the upgraded synthetic gasoline stream is shown in Table 2.

TABLE 2

| Upgraded Synthetic Gasoline | Composition/wt % |
|---|---|
| Aromatics | 21.1 |
| Olefins | 11.6 |
| Benzene | 0.66 |
| Oxygen | 1.1 |
| RON | 91.4 |
| MON | 82.4 |

EXAMPLE 2

Example 1 was repeated. However the hydrocarbon product stream was passed to the cracking reactor at a gas hourly space velocity (GHSV) of $0.90h^{-1}$ and the temperature of the cracking reactor was maintained in the temperature range of 340-398° C. The performance of the cracking reactor was again selected so that the concentration of aromatics in the synthetic gasoline stream produced did not exceed 25 wt % by weight.

The product analysis of the synthetic gasoline stream is shown in Table 3.

TABLE 3

| Yield/wt % | |
|---|---|
| Methane | 0.02 |
| Ethane | 0.09 |
| Ethane | 0.41 |
| Propane | 7.05 |
| Propene | 2.38 |
| i-Butane | 7.57 |
| n-Butane | 7.18 |
| i-Butene | 2.47 |
| n-Butene | 2.57 |
| t-Pentenes | 3.67 |
| o-Pentenes | 1.35 |
| t-Hexenes | 1.51 |
| o-Hexenes | 1.02 |
| Heptenes | 1.92 |
| $C_8$-$C_{11}$ olefins | 5.03 |
| i-Pentane | 6.25 |
| n-Pentane | 5.84 |
| i-Hexane | 4.77 |
| n-Hexane | 3.48 |
| Heptanes | 6.19 |
| $C_8$-$C_{11}$ paraffins | 11.73 |
| Naphthenes | 0.76 |
| Benzene | 0.44 |
| Toluene | 2.29 |
| $C_8$ aromatics | 5.80 |
| $C_9$ aromatics | 5.43 |
| $C_{10}$ aromatics | 2.32 |
| $C_{11}$ aromatics | 0.00 |
| Conversion/wt % | 89.80 |
| Dry Gas | 0.52 |
| LPG | 29.22 |
| Gasoline | 70.28 |
| Cracked Gasoline Composition/wt % | |
| Aromatics | 23.15 |
| Olefins | 22.05 |
| Benzene | 0.63 |
| RON | 90.4 |
| MON | 80.4 |

The synthetic gasoline stream was separated into 4 fractions. A stream comprising C3's was recycled to the reforming zone. A stream comprising C4's was passed to an MTBE reactor wherein the stream was hydrogenated and isomerised to produce iso-butane and then dehydrogenated to produce iso-butene. and then dehydrogented to produce iso-butene. The iso-butene was then reacted with methanol to produce MTBE.

A stream comprising C5's and C6's was passed to the oxygenating reactor wherein iso and tertiary pentenes and hexenes were etherified with methanol. The unreacted C5's were separated and passed to a mild hydrogenating unit before being sent to the C5 isomerisation unit wherein n-pentane was isomerised to iso-pentane.

A C7+ stream was separated from the synthetic gasoline stream and blended with the MTBE, etherified stream and the iso-pentane to produce an upgraded synthetic gasoline.

The amount of MTBE blended into the upgraded synthetic gasoline was adjusted to provide an oxygen content of 2% by weight oxygen i.e. 12% by weight oxygenates.

The product analysis of the upgraded synthetic gasoline stream is shown in Table 4.

TABLE 4

| Upgraded Synthetic Gasoline | Composition/wt % |
|---|---|
| Aromatics | 19.5 |
| Olefins | 12.7 |
| Benzene | 0.52 |
| Oxygen | 2.0 |

TABLE 4-continued

| Upgraded Synthetic Gasoline | Composition/wt % |
|---|---|
| RON | 93.2 |
| MON | 83.2 |

EXAMPLE 3

Example 1 was repeated. However hydrocarbon product stream was passed to the cracking reactor at a gas hourly space velocity (GHSV) of $1.20h^{-1}$. Again the cracking reactor was operated to limit the aromatics production.

The product analysis of the synthetic gasoline stream is shown in Table 5

TABLE 5

| Yield/wt % | |
|---|---|
| Methane | 0.01 |
| Ethane | 0.05 |
| Ethane | 0.35 |
| Propane | 5.51 |
| Propene | 2.66 |
| i-Butane | 5.83 |
| n-Butane | 6.17 |
| i-Butene | 3.19 |
| n-Butene | 3.58 |
| t-Pentenes | 5.98 |
| o-Pentenes | 2.14 |
| t-Hexenes | 2.93 |
| o-Hexenes | 2.05 |
| Heptenes | 5.37 |
| $C_8$-$C_{11}$ olefins | 10.66 |
| i-Pentane | 5.58 |
| n-Pentane | 4.56 |
| i-Hexane | 4.31 |
| n-Hexane | 3.68 |
| Heptanes | 5.46 |
| $C_8$-$C_{11}$ paraffins | 11.25 |
| Naphthenes | 0.67 |
| Benzene | 0.30 |
| Toluene | 0.99 |
| $C_8$ aromatics | 2.88 |
| $C_9$ aromatics | 2.75 |
| $C_{10}$ aromatics | 1.11 |
| $C_{11}$ aromatics | 0.00 |
| Conversion/wt % | 84.70 |
| Dry Gas | 0.40 |
| LPG | 26.92 |
| Gasoline | 72.68 |
| Cracked Gasoline Composition/wt % | |
| Aromatics | 11.05 |
| Olefins | 40.09 |
| Benzene | 0.41 |
| RON | 89.6 |
| MON | 79.1 |

The synthetic gasoline stream was separated into 4 fractions. A stream comprising C3's and C4's was sent to a dehydrocyclodimerisation reactor wherein a stream comprising aromatics was produced.

A stream comprising C5's and C6's was passed to the oxygenating reactor wherein iso and tertiary pentenes and hexenes were etherified with methanol. The unreacted C5's were separated and passed to a mild hydrogenating unit before being sent to the C5 isomerisation unit wherein n-pentane was isomerised to iso-pentane.

A C7+ stream was separated from the synthetic gasoline stream and blended with the MTBE, etherified stream and the iso-pentane to produce an upgraded synthetic gasoline. The product analysis of the upgraded synthetic gasoline stream is shown in Table 6.

TABLE 6

| Upgraded Gasoline | Composition/wt % |
|---|---|
| Aromatics | 25.6 |
| Olefins | 21.1 |
| Benzene | 0.29 |
| Oxygen | 1.1 |
| RON | 95.0 |
| MON | 85.0 |

The examples indicate that the RON and MON values can be increased via the upgrading processes.

The invention will now be described with the aid of FIGS. 1-3.

In FIG. 1 synthesis gas, formed by passing natural gas through an adsorption zone and then subsequently into a reforming zone (not shown), is passed to a Fischer-Tropsch reactor wherein it is converted to a hydrocarbon product stream (also not shown) which is passed via line (1) to a cracking reactor (2) to produce a synthetic gasoline stream.

The synthetic gasoline stream is passed via line (3) to a separator (4) wherein the synthetic gasoline stream is separated to provide at least one stream comprising hydrocarbons containing less than 6 carbon atoms and at least one stream comprising hydrocarbons containing at least 6 carbon atoms. The stream comprising hydrocarbons containing less than 6 carbon atoms is then passed via line (5) to an oxygenating reactor (6) wherein it is reacted with oxygenates to produce a stream comprising ethers which exits the oxygenating reactor (6) via line (7). The stream comprising hydrocarbons containing at least 6 carbon atoms exits the separator (4) via line (8).

The stream comprising ethers is then blended with the stream comprising hydrocarbons containing at least 6 carbon atoms to produce an upgraded synthetic gasoline.

Figure 2:
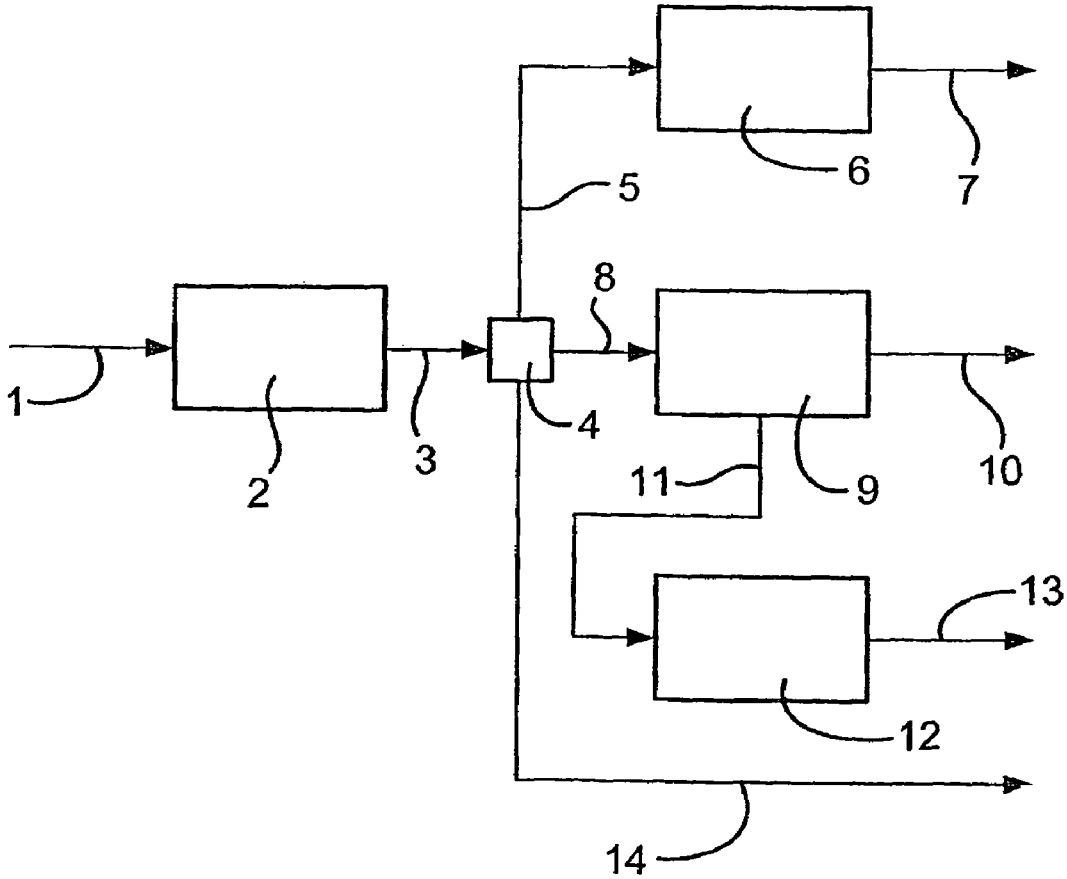

In FIG. 2 synthesis gas, formed by passing natural gas through an adsorption zone and then subsequently into a reforming zone (not shown), is passed to a Fischer-Tropsch reactor wherein it is converted to a hydrocarbon product stream (also not shown) which is passed via line (1) to a cracking reactor (2) to produce a synthetic gasoline stream.

The synthetic gasoline stream is passed via line (3) to a separator (4) wherein the synthetic gasoline stream is separated to provide at least one stream comprising hydrocarbons containing 4 carbon atoms, at least one stream comprising hydrocarbons containing 5-6 carbon atoms and at least one stream comprising hydrocarbons containing at least 7 carbon atoms.

The stream comprising hydrocarbons containing 4 carbon atoms is then passed via line (5) to a methyl tertiary-butyl ether MTBE reactor (6) to produce a stream comprising MTBE which exits the MTBE reactor (6) via line (7). The stream comprising hydrocarbons containing 5-6 carbon atoms is passed via line (8) to an oxygenating reactor (9) wherein it is reacted with oxygenates to produce a stream comprising ethers. The stream comprising ethers exits the oxygenating reactor (9) via line (10). A stream of unreacted hydrocarbons containing 5 carbon atoms is then passed from the oxygenating reactor (9) via line (11) to a C5 isomerisation reactor (12) wherein it is contacted with a C5 isomerising catalyst to produce a stream comprising C5 isoparaparaffins which exits the C5 isomerisation reactor (12) via line (13). The stream comprising hydrocarbons containing at least 7 carbon atoms exits the separator via line (14).

The stream comprising MTBE, the stream comprising ethers, the stream comprising C5 isoparaparaffins and the stream comprising hydrocarbons containing at least 7 carbon atoms are blended to produce an upgraded synthetic gasoline.

Figure 3:
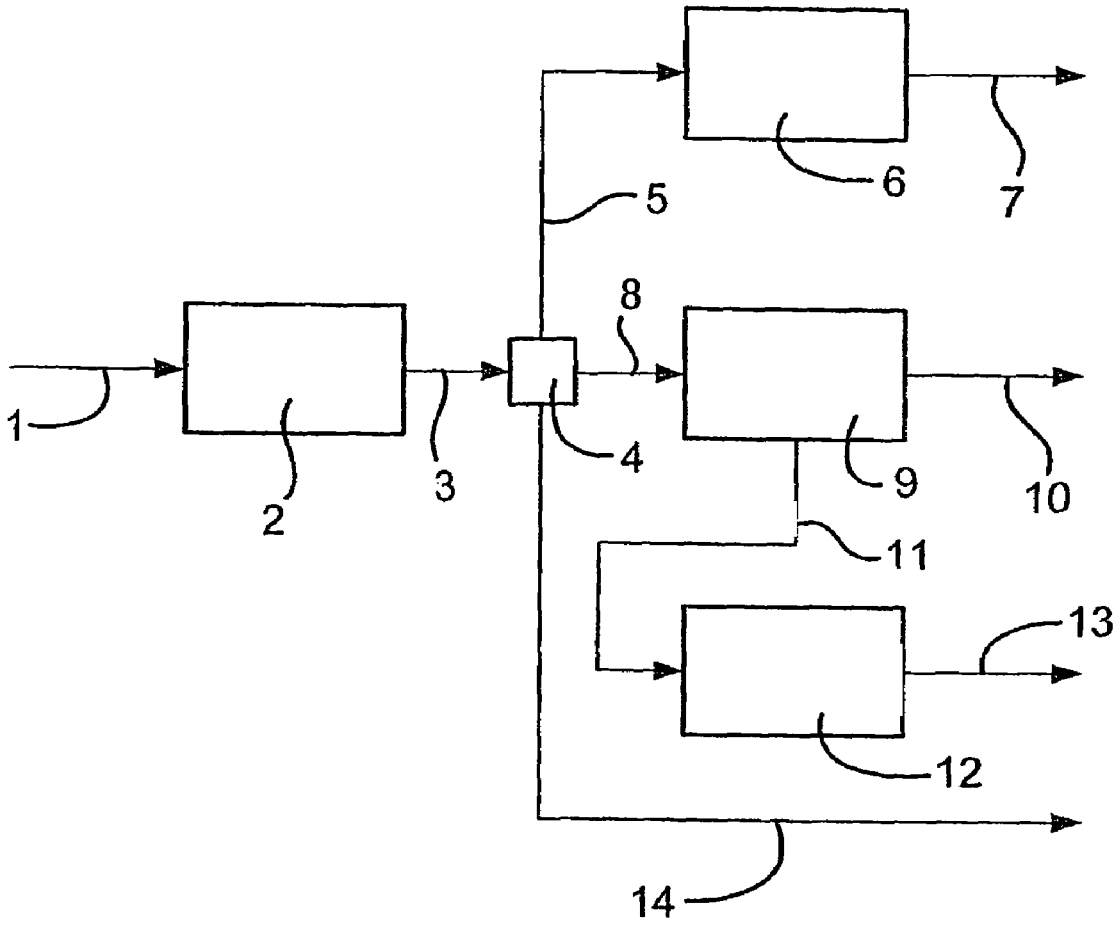

In FIG. 3 synthesis gas, formed by passing natural gas through an adsorption zone and then subsequently into a reforming zone (not shown), is passed to a Fischer-Tropsch reactor wherein it is converted to a hydrocarbon product stream (also not shown) which is passed via line (1) to a cracking reactor (2) to produce a synthetic gasoline stream.

The synthetic gasoline stream is passed via line (3) to a separator (4) wherein the synthetic gasoline stream is separated to provide at least one stream comprising hydrocarbons containing 3-4 carbon atoms, at least one stream comprising hydrocarbons containing 5-6 carbon atoms and at least one stream comprising hydrocarbons containing at least 7 carbon atoms.

The stream comprising hydrocarbons containing 3-4 carbon atoms is then passed via line (5) to a dehydrocyclodimerisation reactor (6) wherein it is contacted with a dehydrocyclodimerisation catalyst to produce a stream comprising aromatics which exits the dehydrocyclodimerisation reactor (6) via line (7). The stream comprising hydrocarbons containing 5-6 carbon atoms is passed via line (8) to an oxygenating reactor (9) wherein it is reacted with oxygenates to produce a stream comprising ethers. The stream comprising ethers exits the oxygenating reactor (9) via line (10). A stream of unreacted hydrocarbons containing 5 carbon atoms may be passed from the oxygenating reactor (9) via line (11) to a C5 isomerisation reactor (12) wherein it is contacted with a C5 isomerising catalyst to produce a stream comprising C5 isoparaparaffins which exits the C5 isomerisation reactor (12) via line (13). The stream comprising hydrocarbons containing at least 7 carbon atoms exits the separator via line (14).

The stream comprising aromatics, the stream comprising ethers, the stream comprising C5 isoparaparaffins and the stream comprising hydrocarbons containing at least 7 carbon atoms are blended to produce an upgraded synthetic gasoline.

The invention claimed is:

1. A process for the production of an upgraded synthetic gasoline comprising:

a) contacting the synthesis gas stream at an elevated temperature and pressure with a Fischer-Tropsch catalyst in a Fischer-Tropsch reactor to generate a hydrocarbon product stream comprising hydrocarbons having a chain length of between 1 to 30 carbon atoms;

b) passing at least a portion of the hydrocarbon product stream to a cracking reactor wherein the hydrocarbon product stream is contacted with a cracking catalyst under conditions which provide a synthetic gasoline stream consisting essentially of hydrocarbons having a chain length of between 1 to 12 carbon atoms;

c) separating the synthetic gasoline stream produced in step (b) to provide at least one stream comprising hydrocarbons containing less than 6 carbon atoms and at least one stream comprising hydrocarbons containing at least 6 carbon atoms;

d) passing the stream comprising hydrocarbons containing less than 6 carbon atoms to an oxygenating reactor wherein it is reacted with oxygenates to produce a stream comprising ethers;

e) blending at least a portion of the stream comprising ethers with the stream comprising hydrocarbons containing at least 6 carbon atoms to produce an upgraded synthetic gasoline;

wherein the cracking reaction is carried out at a temperature of 250-450° C.

2. A process for the production of an upgraded synthetic gasoline comprising:

a) contacting the synthesis gas stream at an elevated temperature and pressure with a Fischer-Tropsch catalyst in a Fisoher-Tropsch reactor to generate a hydrocarbon product stream comprising hydrocarbons having a chain length of between 1 to 30 carbon atoms;

b) passing at least a portion of the hydrocarbon product stream to a cracking reactor wherein the hydrocarbon product stream is contacted with a cracking catalyst under conditions which provide a synthetic gasoline stream consisting essentially of hydrocarbons having a chain length of between 1 to 12 carbon atoms;

c) separating the synthetic gasoline stream from step (b) to provide at least one stream comprising hydrocarbons containing 4 carbon atoms, at least one stream comprising hydrocarbons containing 5-6 carbon atoms and at least one stream comprising hydrocarbons containing at least 7 carbon atoms;

d) passing at least a portion of the stream comprising hydrocarbons containing 4 carbon atoms to a methyl tertiary-butyl ether (MTBE) reactor wherein it is contacted In the presence of an oxygenate with a MTBE catalyst to produce a stream comprising a MTBE, passing the stream comprising hydrocarbons containing 5-6 carbon atoms to an oxygenating reactor wherein it is reacted with oxygenates to produce a stream comprising ethers and optionally passing unreacted hydrocarbons containing 5 carbon atoms from the oxygenating reactor to a C5 isomerisation reactor wherein it is contacted with a C5 isomerising catalyst to produce a stream comprising C5 isoparaparaffins;

e) blending the stream comprising MTBE, the stream comprising ethers, optionally the stream comprising C5 isoparaparaffins from step (d) and the stream comprising hydrocarbons containing at least 7 carbon atoms from step (c) to produce an upgraded synthetic gasoline;

wherein the cracking reaction is carried out at a temperature of 250-450° C.

3. A process according to claim 2 wherein the MTBE reaction is carried out at a temperature of 30-100 ° C.

4. A process according to claim 2 wherein the MTBE reaction is carried out at a pressure of 10-50 bar.

5. A process according to claim 2 wherein the MTBE reaction is carried out in the presence of an oxygenate.

6. A process for the production of an upgraded synthetic gasoline comprising:

a) contacting the synthesis gas stream at an elevated temperature and pressure with a Fischer-Tropsch catalyst in a Fischer-Tropsch reactor to generate a hydrocarbon product stream comprising hydrocarbons having a chain length of between 1 to 30 carbon atoms;

b) passing at least a portion of the hydrocarbon product stream to a cracking reactor wherein the hydrocarbon product stream is contacted with a cracking catalyst under conditions which provide a synthetic gasoline stream consisting essentially of hydrocarbons having a chain length of between 1 to 12 carbon atoms;

c) separating the synthetic gasoline stream from step (b) to provide at least one stream comprising hydrocarbons containing 3-4 carbon atoms, at least one stream comprising hydrocarbons containing 5-6 carbon atoms and at least one stream comprising hydrocarbons containing at least 7 carbon atoms;

d) passing at least a portion of the stream comprising hydrocarbons containing 3-4 carbon atoms to a dehydrocyclodimerisation reactor wherein it is contacted with a dehydrocyclodimerisation catalyst to produce a stream comprising aromatics, passing the stream comprising hydrocarbons containing 5-6 carbon atoms to an oxygenating reactor wherein it is reacted with oxygenates to produce a stream comprising ethers and optionally passing unreacted hydrocarbons containing 5 carbon atoms from the oxygenating reactor to a C5 isomerisation reactor wherein it is contacted with a C5 isomerising catalyst to produce a stream comprising C5 isoparaparaffins;

e) blending the stream comprising aromatics, the stream comprising ethers, optionally the stream comprising C5 isoparaparaffins from step (d) and that stream comprising hydrocarbons containing at least 7 carbon atoms from step (c) to produce an upgraded gasoline;

wherein the cracking reaction is carried out at a temperature of 250-450° C.

7. A process according to claim 1 wherein the synthesis gas is produced by contacting a natural gas stream comprising sulphur with an adsorbent in an adsorption zone to produce a natural gas stream with reduced sulphur content and an adsorbent with an increased sulphur content and reacting said natural gas stream with reduced sulphur content in at least one reforming zone to produce the synthesis gas stream.

8. A process according to claim 7 wherein the natural gas stream comprising sulphur is contacted with the adsorbent at a temperature of between 250-500° C.

9. A process according to claim 7 wherein the natural gas stream comprising sulphur is contacted with the adsorbent at a pressure of 10-100 bar.

10. A process according to claim 7 wherein the adsorbent is a zinc oxide adsorbent.

11. A process according to claim 7 wherein the reforming reaction is carried out at a temperature in the range of from 700to 1100° C.

12. A process according to claim 1 wherein the reforming reaction is carried out at a pressure in the range of from 10 to 80 bar.

13. A process according to claim 1 wherein the Fischer-Tropsch reaction is carried out at a temperature of 180-360° C.

14. A process according to claim 1 wherein the Fischer-Tropsch reaction is carried out at a pressure of 5-50 bar.

15. A process according to claim 1 wherein the Fischer-Tropsch catalyst comprises cobalt supported on zinc oxide.

16. A process according to claim 1 wherein the synthesis gas is contacted with a suspension of a particulate Fischer-Tropsch catalyst in a liquid medium in a system comprising at least one high shear mixing zone and a reactor vessel.

17. A process according to claim 1 wherein the cracking reaction is carried out at a temperature of 330-430° C.

18. A process according to claim 1 wherein the cracking reaction is carried out at a pressure of 10-50 bar.

19. A process according to claim 1 wherein the oxygenating reactor comprises an oxygenating catalyst.

20. A process according to claim 19 wherein the oxygenating catalyst is a sulphonated macroporous ion exchange resin.

21. A process according to claim 1 wherein the oxygenating reaction is carried out at a temperature of 20° C.-200° C.

22. A process according to claim 1 wherein the oxygenating reaction is carried out at a pressure of 10-50 bar.

23. A process according to claim 6 wherein the dehydrocyclodimerisation reaction is carried out at a temperature of 350-750° C.

24. A process according to claim 6 wherein the dehydrocyclodimerisation reaction is carried out at a pressure of 10-40 bar.

25. A process according to claim 5 wherein the MTBE reaction is carried out in the presence of methanol.

* * * * *